US006938776B2

(12) United States Patent
Rem et al.

(10) Patent No.: US 6,938,776 B2
(45) Date of Patent: Sep. 6, 2005

(54) METHOD AND A DEVICE FOR THE SEPARATION OF PARTICLES

(75) Inventors: Peter Carlo Rem, Rijswijk (NL); Norbert Otto Fraunholcz, Zoetermeer (NL); Laurens Anton Van Kooy, Voorburg (NL)

(73) Assignee: Technische Universiteit Delft, Delft (NL)

( * ) Notice: Subject to any disclaimer, the term of this patent is extended or adjusted under 35 U.S.C. 154(b) by 0 days.

(21) Appl. No.: 10/640,769

(22) Filed: Aug. 13, 2003

(65) Prior Publication Data

US 2004/0099576 A1 May 27, 2004

Related U.S. Application Data

(63) Continuation of application No. PCT/NL02/00094, filed on Feb. 14, 2002.

(30) Foreign Application Priority Data

Feb. 15, 2001 (NL) ..... 1017367

(51) Int. Cl.[7] ..... B03B 7/00; B03B 5/68

(52) U.S. Cl. ..... 209/13; 209/159; 209/454

(58) Field of Search ..... 209/13, 17, 18, 209/44, 159, 186, 188, 234, 268, 423, 424, 425, 426, 454, 455, 456

(56) References Cited

U.S. PATENT DOCUMENTS 1,128,807 A 2/1915 Magee
2,426,337 A * 8/1947 Bird ..... 209/424
3,087,619 A 4/1963 Kraut
4,070,275 A * 1/1978 Stoev et al. ..... 209/44
4,071,304 A * 1/1978 Chauvin et al. ..... 427/185
4,772,384 A 9/1988 Schoonert et al.

FOREIGN PATENT DOCUMENTS

DE 2133802 1/1973
DE 4132938 A1 4/1993
FR 1101690 10/1955
FR 2568144 A1 * 1/1986 ..... B03B/5/24

OTHER PUBLICATIONS

English Translation of Patent FR 1101690 (Invetor: Dantec et al. Date: Oct. 10, 1995).*

* cited by examiner

*Primary Examiner*—Donald P. Walsh
*Assistant Examiner*—Joseph C Rodriguez
(74) *Attorney, Agent, or Firm*—Peacock Myers P.C.; Jeffrey D. Myers; Janeen Vilven

(57) ABSTRACT

A method of separating a mixture of particles in a liquid that within chosen limits have different physical property values, wherein the particles to be separated are supplied via a feeder to a screen upon which a layer of facilitating particles is disposed the size of the facilitating parties being too large to fit through the openings in the screen, wherein particles to be separated are passed through the layer of facilitating particles and through the openings in the screen and collected under the screen, the density of the particles being greater than that of the liquid, and wherein a repetitive vertical movement is provided between the particles and the liquid, respectively.

14 Claims, 2 Drawing Sheets

METHOD AND A DEVICE FOR THE SEPARATION OF PARTICLES

CROSS-REFERENCE TO RELATED APPLICATIONS

This application is continuation application of International Patent Application Ser. No. PCT/NL02/00094, entitled "A Method and A Device for the Separation of Particles" to Peter Carlos Rem, having an international filing date of Feb. 14, 2002, and claiming priority to Netherlands Patent Application Ser. No. 1017367, having a filing date of Feb. 15, 2001, and the specifications thereof are incorporated herein by reference.

STATEMENT REGARDING FEDERALLY SPONSORED RESEARCH OR DEVELOPMENT (Not Applicable)

INCORPORATION BY REFERENCE OF MATERIAL SUBMITTED ON A COMPACT DISK OR MICROFICHE APPENDIX (Not Applicable)

BACKGROUND OF THE INVENTION

The present invention relates to a method of in a liquid separating a mixture of particles that within chosen limits have different physical property values, wherein the particles to be separated are supplied via a feeder to a screen upon which a layer of facilitating particles is disposed, the size of the facilitating particles being too large to fit through the openings in the screen, wherein particles to be separated are passed through the layer of facilitating particles and through the openings in the screen and collected under the screen, the density of the particles being greater than that of the liquid, and wherein a repetitive vertical movement is provided between the particles and the liquid, respectively. Furthermore, the invention relates to a device for carrying out such a method.

Such a method and device are known from the American patent specification U.S. Pat. No. 4,772,384. This patent mentions the separation of very small particles with dimensions up to 1 mm and which are of mineral origin, such as coal, ore and the like. The separation is based only on the differences in density of the particles to be separated. Particles having a highest density will pass through the layer of facilitating particles and the screen downward, while particles having a lowest density will remain behind on the layer of facilitating particles and will be removed from above the same.

In the known method, liquid is fed from below upward through the separating screen. This will push the facilitating particles also upward together with the particles to be separated. When the upward movement is stopped, or even reversed into a downward movement of the liquid, the particles, in particular the heaviest particles, will have occupied the spaces formed between the facilitating particles. After such liquid flow movement has been repeated several times, a considerable portion of the heavier particles will have passed the layer of facilitating particles and the screen. These particles can subsequently be collected under the screen in a suitable receptacle.

A drawback of this known method is that with the heavier particles a considerable portion of the lighter particles will also pass through the screen downward and be collected in the receptacle. This problem is very noticeable especially if there is little difference between the various densities of particles to be separated. Moreover, this known method has only been shown to be useful in practice when separating mixtures comprising heavy to very heavy particles and much lighter particles such as mixtures of coals or ores with contaminants.

Another drawback of this method is that in many cases, simultaneous with the removal of the lighter particles, it is also necessary to remove a portion of the layer of facilitating particles. This results in a more complex process as well as in considerable wear on the facilitating particles.

Finally, this known method has the drawback that two layers of different types of facilitating particles are required on the separating screen: a bottom layer of relatively heavy material that will not be displaced by the liquid, and a top layer of lighter material.

BRIEF SUMMARY OF THE INVENTION

The general object of the present invention is to provide an improved method.

The particular object of the invention is to provide a method that can also be used for separating mixtures of relatively light particles. It is also the object of the invention to provide a method that can be used for separating mixtures of particles with different dimensions and whose density differs only slightly.

The invention aims also at providing a method by means of which a mixture can be separated on the basis of differences of various to be chosen physical properties.

An additional object of the invention is to provide a device for economically carrying out such a method.

In order to achieve at least one of the above-mentioned objects, the invention provides a method as mentioned in the preamble and which is characterized in that all particles to be separated are passed through the layer of facilitating particles and the separating screen, and wherein the particles having a physical property value lying near the upper limit will move faster through the layer of facilitating particles and the screen than the particles having a physical property value lying near the lower limit.

As in accordance with the invention all the particles are passed through the screen there is no need to pump the facilitating particles. This limits the wear on the facilitating particles to a minimum.

It is also surprising that by means of the method according to the invention relatively light particles whose density is little higher than that of the liquid can also be separated very well. If in this description a reference is made to density ratios, relative density ratio values are meant, ie the density of the particle minus the density of the liquid. When using water, the method may be applied for solid particles having a density that is higher than 1.0 g/cm$^3$, preferably at least 1.03 g/cm$^3$. Especially plastics can be separated very well in water.

The method according to the invention is especially advantageous if the smallest diameter of the facilitating particles is at least 2.5 times the size of the smallest dimension of the particles to be separated.

Advantageously, for example, the facilitating particles are approximately spherical, cylindrical or polygonal, such as for example cubic. Particularly preferred are substantially spherical facilitating particles.

Particles having approximately the same density but different volume/surface ratios are also suitable for separation.

According to a further preferred embodiment, the facilitating particles have a density and size such that the heavier particles pass through the layer of facilitating particles more quickly than the lighter particles.

According to another preferred embodiment, the particles having a greater volume/surface ratio pass though the layer of facilitating particles more quickly than the particles having a smaller volume/surface ratio.

According to a further embodiment, the material to be separated comprises plastic particles.

A very good separation is obtained in particular if the feeder comprises a feeder screen having an optional slope in the direction of the separating screen, wherein the supplied particles to be separated are provided with a repetitive, substantially vertical motion such that the particles having the greatest physical property value will assume a lowest position and the particles having the lowest property value will assume a highest position on the feeder screen, in order to subject the particles to be separated to a preliminary sorting before they are fed to the separating screen. The feeder screen may, for example, be positioned at a slant, causing the particles to be separated to be moved simultaneously over the feeder screen to the separating screen. In this way the material to be separated arrives on the layer of facilitating particles in principal already pre-sorted. This will result in a better separation.

The device according to the invention comprises a separating screen on which a layer of facilitating particles is provided which cannot pass through the separating screen, a feeder for supplying the particles to be separated on the layer of facilitating particles, the smallest diameter of the particles to be separated being smaller than that of the openings in the separating screen, and means for providing a relatively vertical motion of the particles in relation to the liquid, in order to pass the particles to be separated through the layer of facilitating particles and the separating screen, and wherein receiving means are provided under the separating screen for receiving the particles passed through the separating screen.

According to a preferred embodiment, the device comprises means for moving the separating screen and the particles therein in a horizontal direction, and wherein receiving means are provided under the separating screen and in the path of movement so that particles of different physical property values are collected in different receiving means.

One particular preferred embodiment provides a circular separating screen moved in a circular motion with each part of the separating screen successively passing through a feeder section for material to be separated and at least two sorting sections for the respective sorting of particles having different physical property values.

Further preferred embodiments are mentioned in the subclaims.

The invention will be elucidated with reference to the drawing and one preferred embodiment. When this description mentions that all particles of the facilitating layer have the same density, it means that the density is not significantly different. In practice it means that the facilitating particles behave as if they all had the same density. They must always be randomly distributed over the layer in the separating screen.

Analogous to the method described in the American patent U.S. Pat. No. 4,772,384, the method according to the present invention induces a porosity in the layer of the facilitating particles. According to the present invention this is done by inducing a relative movement between the particles and the liquid, for example, by a vertical up and down movement of the separating screen and the particles thereon. In the latter case, during the downward movement of the separating screen, the particles will exhibit a delayed movement in relation to the screen, resulting in a certain degree of porosity. This porosity depends among other things on the distance over which the screen moves downwards and the speed of the movement. This allows the particles to be separated to move about between the facilitating particles in order to be finally passed through the separating screen downward.

If in the horizontal plane the separating screen is stationary, and the particles to be separated are randomly distributed over the entire surface of the screen, the heaviest particles will pass first through the separating screen and later the lighter particles. In order to remove the lighter particles passing through the screen separately, a first receptacle may be provided under the screen while the heaviest particles are passing through the screen, and this receptacle is replaced by another receptacle when the lighter particles are passing through the screen. A possible option is to provide an additional receptacle under the screen if during a certain period both heavier and lighter particles are passing through the screen. Optionally this mixture can later be re-applied to the screen for a further separation.

If the separating screen moves in the horizontal plane, a plurality of receptacles may be placed under the screen and in the direction of movement of the screen, the receptacle located under the first part of the path of movement collecting the heaviest particles and the last receptacle collecting lighter particles. In this case also it is possible to provide more than two receptacles, with one or more intermediate receptacles collecting a mixture of the heavier and lighter particles. If the mixture consists of particles to be separated having more than two physical property values, for example, three, or four, or even five different values, an equal number or more receptacles may be provided under the screen.

BRIEF DESCRIPTION OF THE SEVERAL VIEWS OF THE DRAWINGS

The invention will be elucidated below with reference to the figures.

DETAILED DESCRIPTION OF THE INVENTION

Below reference will be made in particular to particles having different densities. However, the description is equally applicable to particles having other differing physical properties, such as volume/surface ratio.

Figure 1:
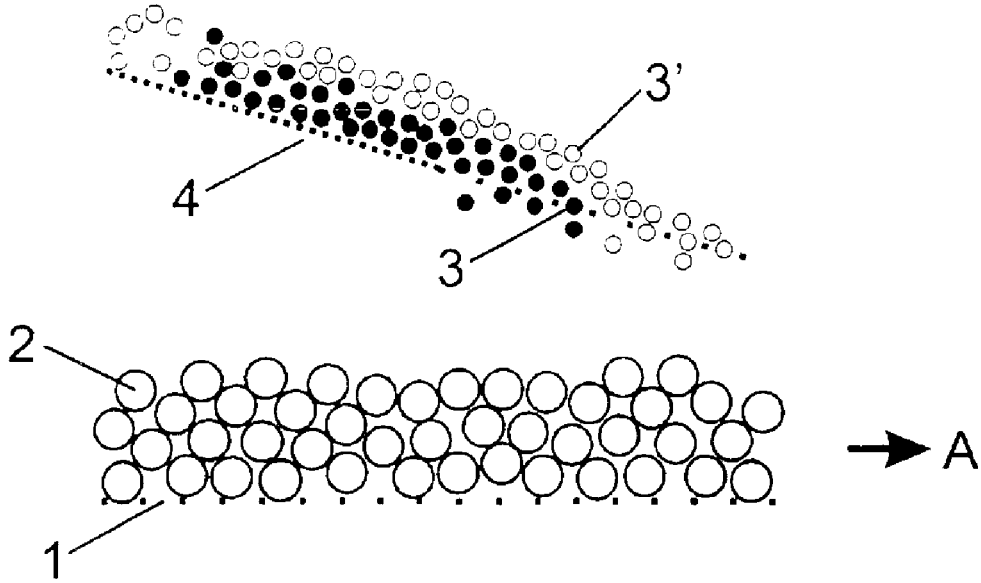
FIG. 1 shows a schematic side view of a screen and a feeder for use with the method according to the invention.

FIG. 1 shows a separating screen 1, provided with a layer of facilitating particles 2. As can be seen from the figure, the facilitating particles have a slightly larger diameter than the openings in the screen 1, such that they cannot pass through the openings in the screen 1. Material to be separated 3, 3', comprised of particles having a low density 3' (white in the figure) and particles having a higher density 3 (black in the figure) are fed from the top onto the layer of facilitating particles 2. This feeding occurs via a feeder screen 4. As shown in FIG. 1, the feeder screen is provided at its left side with relatively fine openings so that there the particles cannot pass through, whereas liquid is able to flow through. More to the right the openings in the feeder screen are large enough for the particles to be separated to be able to fall downward through the screen.

Figure 2:
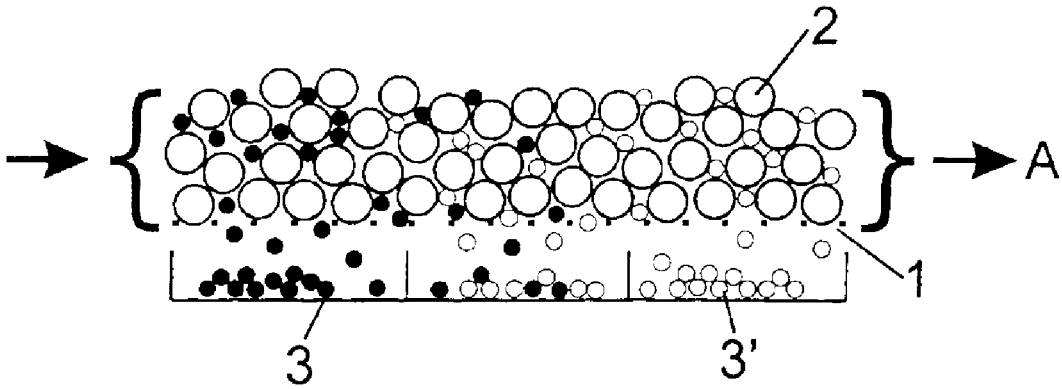
FIG. 2 shows a schematic side view of a separating screen according to the invention.

The feeder may optionally terminate at a position immediately above the layer of facilitating particles. According to a preferred embodiment said feeder consists of a feeder screen, inducing the material to be separated 3, 3' to make a vertical movement. This results in the heavier particles 3 assuming a relatively lower position and the lighter particles 3' a relatively higher position. The amplitude and frequency of the feeder screen are preferably the same as those of the separating screen. Especially in the case shown in FIG. 1, when the separating screen 1 as well as the layer of facilitating particles 2 thereon are moved in the direction of the arrow A, such a preliminary sorting by means of a feeder screen 4 will result in the heavier particles 3 forming a bottom layer on top of the layer of facilitating particles 2 and the lighter particles 3' will fall on top of the heavier particles 3. Even if there is no such movement of the separating screen 1, such a method of feeding with the aid of a feeder screen 4 will result in only the heaviest particles 3 falling on a left hand position as shown in FIG. 2, and the lighter particles 3' falling on a right hand position. Both heavy and light particles 3, 3' will fall on an intermediate part. This portion in the middle can be supplied anew for separation in the manner depicted, for example, as in FIG. 1. Also, if the material to be separated comprises particles of more than two densities, it is convenient to use this manner of feeding with a preliminary sorting.

Figure 3:
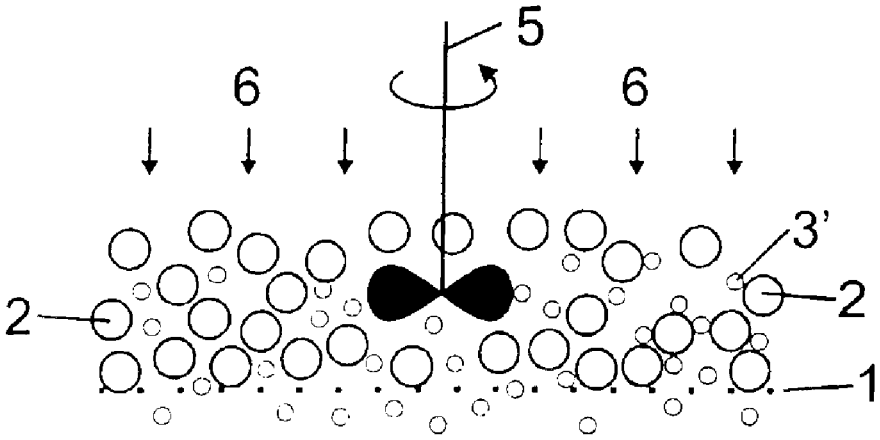
FIG. 3 shows a schematic side view of a particular embodiment of a screen for use with the method according to the invention.

If it is difficult by means of the present invention for the particles with the lowest density to pass through the layer of facilitating particles, the porosity of the layer of facilitating particles may be increased locally, for example, by providing an agitator in this layer as shown in FIG. 3. The increased porosity will make it easy for the lighter particles 3' to pass through the separating screen.

Another manner of guiding the lighter particles through the layer of facilitating particles is to direct one or more jets of liquid 6 at this layer, thereby disrupting the cohesion in the packing. This gives the lighter particles the chance of being transported through said layer and through the separating screen. The jet of liquid may be directed at the layer from above or from below. A combination of agitator and jet(s) of liquid is also possible.

Incidentally, FIG. 2 shows the horizontal movement of the separating screen in the direction of the arrow A, from which follows that in a first part of the path of movement the heavy particles 3 pass though the layer of facilitating particles 2 and the separating screen 1 downward, and in a second part both heavy and light particles 3, 3' pass through, and finally, in a third part the lightest particles 3' pass through. Although not shown in the figure, the lightest particles 3' will be on top of the layer of facilitating particles at the left most position in the figure.

Figure 4:
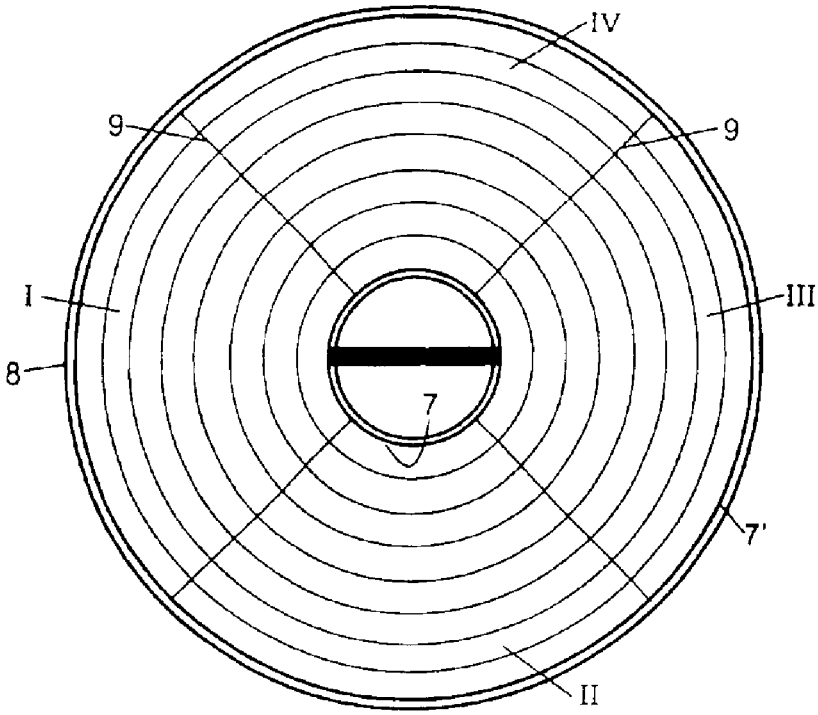
FIG. 4 shows a schematic top view of a screen according to the invention.
Figure 5:
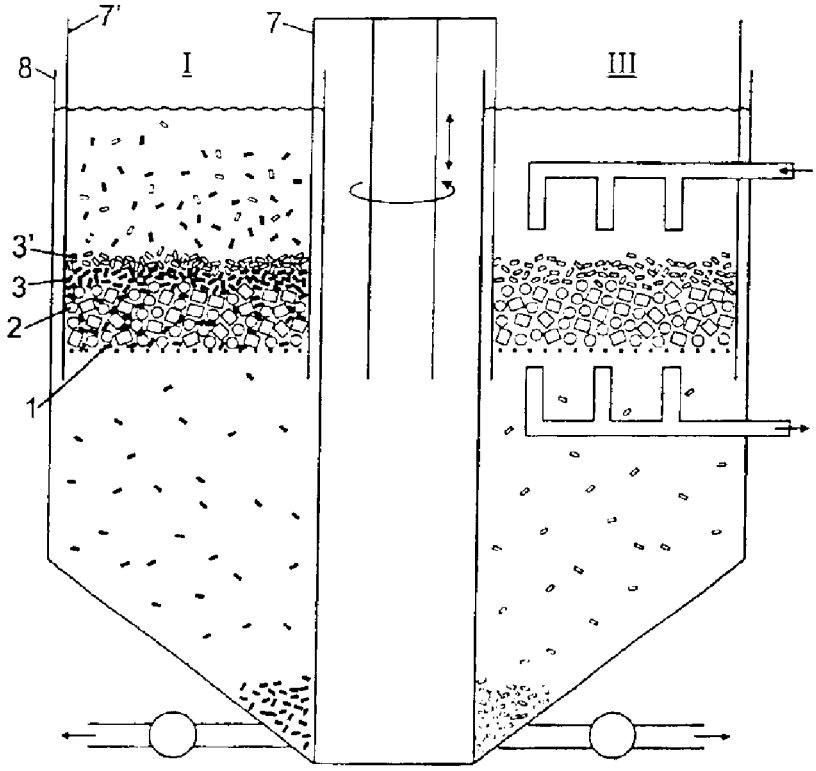
FIG. 5 shows a schematic side view of the screen according to FIG. 4.

FIG. 4 shows a top view of a rotating device according to the invention. The separating screen deck with the layer of facilitating particles thereon as well as the material to be separated are schematically represented by concentric circles. The separating screen can be rotated anticlockwise. FIG. 5 shows a side view of a cross section of this device. The material to be separated is fed into compartment I, where it falls on top of a layer of facilitating particles 2, which are kept in place by a screen 1. With the aid of receiving means 7 the separating screen 1 is connected with means, which are capable of conferring a vertical movement on said screen and the material thereon. The means 7 also form a rim projecting above the surface of the liquid, to prevent the particles to be separated from coming outside the respective segment.

The separating screen as shown in FIG. 4 comprises four compartments I, II, III, IV, separated from one other by means of partitions 9. Said partitions 9 extend from the screen 1 to a position above the surface of the liquid, corresponding to the side wall 7'. The inclusion of partitions is not obligatory. Such a partition serves mainly to prevent the facilitating particles from becoming unevenly distributed over the separating screen and/or the liquid from inducing undesirable currents. As can be seen in FIG. 5, the heavier particles 3 in the compartment I will pass through the layer of facilitating particles and the separating screen downward. The fact that the separating screen rotates means that when the respective screen surface has reached the position of compartment III, it will only contain the particles with the lowest density. These may be caused to pass through the layer of facilitating particles and the screen in the above-described manner by, for example, directing jets of liquid under pressure from above onto the layer of facilitating particles. This changes the structure in such a way that the lighter particles are able to simply pass through this layer. They may then be removed from the receptacle below the device.

EXAMPLE

A mixture of plastic particles to be separated, obtained from ground hub caps, has dimensions of 2–5 mm and is comprised of 66% by weight of polyamides and 34% by weight of other lighter plastics, among which polystyrene, ABS, SAN, and ASA. The density of the polyamides is 1.15 to 1.54 g/cm$^3$, with an average density of 1.37 g/cm$^3$. The densities of the remaining plastics are 1.04 to 1.17 g/cm$^3$ with an average density of 1.10 g/cm$^3$. In order to allow an precise analysis of the separation to be carried out, the polyamide particles are dyed.

The separation screen (of the type bar grizzly) has a screen surface of 885 cm$^2$, the mesh is 8 mm and the bar thickness is 2 mm. The vertical amplitude of the separating screen is 78 mm, and the frequency is 0.2 Hz. The facilitating particles have a length of 13 mm and a diameter (that is the smallest dimension) of 10 mm. The density of the facilitating particles is 1.135 g/cm$^3$. The total weight of the facilitating particles is 3.9 kg.

The separating screen is disposed in a tank filled with water, comprising in the centre a cylindrical space for the drive of the separating screen. The height of the tank is 290 mm and the diameter is 370 mm. The diameter of the drive part is 125 mm. Around the entire periphery of the bar grizzly a rim is provided projecting above the surface of the liquid at all times in order to prevent any material to be separated from escaping from the screen. The screen deck makes an up-and-down movement at the above-mentioned amplitude and frequency. The rate of rotation of the screen is 1 revolution per 100 s. The cylindrical facilitating particles are disposed on the separating screen.

In 100 s an amount of 1 kg of previously moistened plastic particles to be separated was fed to the screen.

Analysis of the product collected in receptacles provided under the separating screen showed a polyamide purity of 95% and a yield of approximately 80%.

It will be understood that the invention is not limited to the above-described and figuratively illustrated manner. For example, the screen surface may be moved linearly instead of rotatingly as shown in the FIGS. 4 and 5. Instead of water it is possible to use any other suitable liquid that does not have any adverse effects on the particles to be separated. However, this liquid must have a lower density than that of the particles to be separated. It is also possible to provide the device shown in the FIGS. 4 and 5 with two feeders instead of one. Said feeders may then be placed at the position of the compartments I and III. The heaviest portion of the material to be separated can then also be removed in said compartments, and the lightest particles can be removed at the position of the compartments II and IV. Optionally more than four compartments may be formed, for example 6 (I–VI). Particles to be separated may then be fed into the compartments I and IV; in the compartments II and V the heavy particles may be removed; and in the compartments III and VI the light particles may be removed.

The thickness of the layer of facilitating particles is preferably at least twice the smallest dimension of the facilitating particles, and preferably at least four times the smallest dimension of said particles. The thickness of the layer of facilitating particles is preferably not more than 15 times the smallest dimension of the particles. The layer thickness that is most preferred is 6–10 times, in particular 8 times the smallest dimension of the facilitating particles. The method according to the invention has been shown to very precisely provide a very good separation of particles whose density differs by only 0.1 g/cm$^3$ (100 kg/m$^3$). This is much more exact than has been possible with the method of the prior art.

What is claimed is:

1. A method of separating a mixture of particles in a liquid that within chosen limits have different physical property values, comprising the steps of:

supplying the particles to be separated via a feeder to a separating screen upon which a layer of facilitating particles is disposed, the size of the facilitating particles being too large to fit through openings in the screen;

passing the particles to be separated through the layer of facilitating particles and through the openings in the screen;

collecting the particles under the screen, a density of the particles to be separated being greater than that of the liquid;

providing a repetitive vertical movement between the particles and the liquid, respectively; and passing all the particles to be separated through the layer of facilitating particles and the separating screen, wherein the particles having a physical property value lying near an upper limit will move faster through the layer of facilitating particles and the screen than the particles having a physical property value lying near a lower limit.

2. The method according to claim 1, additionally comprising the step of increasing porosity of at least a part of the layer of facilitating particles, so as to facilitate the particles having a physical property value lying near the lower limit to be passed through said layer.

3. The method according to claim 1, additionally comprising the step of increasing porosity of the layer of facilitating particles by positioning an agitator in said layer or by directing a liquid jet into said layer.

4. The method according to claim 1, wherein a density of the facilitating particles is lower than the density of the particles to be separated having a physical property value lying near the upper limit and in that the layer of facilitating particles is periodically fluidized during the separation method.

5. The method according to claim 1 wherein the physical property values comprises a density of the particles to be separated.

6. The method according to claim 1, wherein the physical property values comprises a volume/surface ratio of the particles to be separated.

7. The method according to claim 6, wherein a value of the upper limit is at least thrice that of a value of the lower limit.

8. The method according to claim 1, wherein a smallest dimension of the facilitating particles is at least 2.5 times the size of a smallest dimension of the particles to be separated.

9. The method according to claim 1, wherein relative movement of the particles in relation to the liquid is obtained by a repeated up an down movement of the separating screen and the particles disposed thereon.

10. The method according to claim 1, wherein the particles to be separated comprise plastic particles.

11. The method according to claim 1, wherein the particles to be separated have a density that is higher than 1.0 g/cm$^3$.

12. The method according to claim 1, wherein the feeder comprises an oscillating surface and wherein the supplied particles to be separated are provided with a repetitive substantially vertical motion such that the particles having a greatest physical property value will assume a lowest position and the particles having a lowest physical property value will assume a highest position on the feeder surface, in order to subject the particles to be separated to a preliminary sorting before they are fed to the separating screen.

13. The method according claim 1, wherein the facilitating particles have a density and size such that heavier particles pass through the layer of facilitating particles more quickly than lighter particles.

14. A method of separating a mixture of particles in a liquid that within chosen limits have different physical property values, comprising the steps of:

supplying the particles to be separated via a feeder to a separating screen upon which a layer of facilitating particles is disposed, the size of the facilitating particles being too large to fit through openings in the screen;

passing the particles to be separated through the layer of facilitating particles and through the openings in the screen;

collecting the particles under the screen, a density of the particles to be separated being greater than that of the liquid;

providing a repetitive vertical movement between the particles and the liquid, respectively, by repeatedly moving the separating screen and the particles disposed thereon in an up and down manner; and passing all the particles to be separated through the layer of facilitating particles and the separating screen, wherein the particles having a physical property value lying near an upper limit will move faster through the layer of facilitating particles and the screen than the particles having a physical property value lying near a lower limit.

* * * * *